US009444161B2

(12) United States Patent
Huang

(10) Patent No.: US 9,444,161 B2
(45) Date of Patent: Sep. 13, 2016

(54) MULTIPLE-IN-ONE RECEPTACLE CONNECTOR

(71) Applicant: Advanced-Connectek Inc., New Taipei (TW)

(72) Inventor: Fan-Cheng Huang, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 14/722,190

(22) Filed: May 27, 2015

(65) Prior Publication Data

US 2015/0349444 A1 Dec. 3, 2015

(30) Foreign Application Priority Data

May 30, 2014 (TW) ..... 103209628 U

(51) Int. Cl.

| | |
|---|---|
| ***H01R 12/71*** | (2011.01) |
| ***H01R 13/6581*** | (2011.01) |
| ***H01R 13/52*** | (2006.01) |
| ***H01R 13/58*** | (2006.01) |
| ***H01R 27/02*** | (2006.01) |

(52) U.S. Cl.

CPC ..... *H01R 12/71* (2013.01); *H01R 13/521* (2013.01); *H01R 13/58* (2013.01); *H01R 13/6581* (2013.01); *H01R 27/02* (2013.01)

(58) Field of Classification Search

USPC ..... 439/607.35, 566, 540.1, 541.5, 626

See application file for complete search history.

(56) References Cited

U.S. PATENT DOCUMENTS

| | | | | |
|---|---|---|---|---|
| 6,869,311 | B2 * | 3/2005 | Somura | H05K 3/301 439/566 |
| 7,118,414 | B2 * | 10/2006 | Spears | G06F 1/182 439/540.1 |
| 7,192,198 | B1 * | 3/2007 | Chen | G02B 6/32 385/76 |
| 7,349,603 | B2 * | 3/2008 | Souriau | G02B 6/266 257/184 |
| 7,651,370 | B2 * | 1/2010 | Chuang | H01R 23/6873 439/540.1 |
| 7,677,925 | B2 * | 3/2010 | Chuang | H05K 5/0247 439/541.5 |
| 7,867,040 | B2 * | 1/2011 | Yu | H01R 13/518 439/701 |
| 8,011,961 | B2 * | 9/2011 | Liu | H01R 4/64 439/607.58 |

(Continued)

*Primary Examiner* — Alexander Gilman

(74) *Attorney, Agent, or Firm* — Alan D. Kamrath; Kamrath IP Lawfirm, P.A.

(57) ABSTRACT

A multiple-in-one receptacle connector used for an audio equipment includes an insulating housing, receptacle connectors, and sealants. The insulating housing has a top surface having cavities disposed thereon and a bottom surface. Each cavity has a bottom having through holes disposed thereon and penetrating through the bottom surface. Each receptacle connector accommodated in the corresponding cavity includes terminals. Each terminal has a soldering section extending backward out of the corresponding receptacle connector. The soldering sections of each receptacle connector pass through the through holes disposed on the bottom of the corresponding cavity, respectively, to be out of the bottom surface. Each sealant disposed on the bottom surface seals gaps formed between the soldering sections of each receptacle connector and the through holes disposed on the bottom of the corresponding cavity. Sounds are prevented from leaking from gaps by the sealants sealing the gaps.

11 Claims, 7 Drawing Sheets

(56) References Cited

U.S. PATENT DOCUMENTS 8,157,584 B2 * 4/2012 Zhou ..... H01R 13/518 439/540.1
8,221,160 B2 * 7/2012 Liu ..... H01R 13/6658 439/540.1
8,246,386 B1 * 8/2012 DeVito ..... H01R 13/6466 439/626
8,430,692 B2 * 4/2013 Peng ..... H01R 13/518 439/607.46
8,449,331 B2 * 5/2013 Phillips ..... H01R 13/6581 361/704
8,864,515 B2 * 10/2014 Oh ..... H01R 13/5213 439/490
9,077,128 B2 * 7/2015 Choi ..... H01R 13/64
9,097,862 B2 * 8/2015 Tanaka ..... G02B 6/3817
9,112,296 B2 * 8/2015 Zhang ..... H01R 13/516
9,112,312 B2 * 8/2015 Katayanagi ..... H01R 13/6582
9,136,616 B2 * 9/2015 Zhao ..... H01R 12/724
9,136,627 B2 * 9/2015 Miura ..... H01R 12/777

* cited by examiner

MULTIPLE-IN-ONE RECEPTACLE CONNECTOR

BACKGROUND OF THE INVENTION

1. Field of the Invention

The present invention relates to an electrical connector and, more particularly, to a multiple-in-one receptacle connector.

2. Description of the Prior Art

Receptacle connectors used for audio equipment generally include, for example, audio, power, and Universal Serial Bus (USB) receptacle connectors. In order to be capable of receiving different types of plug connectors, different types of corresponding receptacle connectors are integrated into the same housing to form a multiple-in-one receptacle connector to be soldered on a circuit board and then mounted on a casing of the audio equipment. However, because of size tolerances of the housing and the different types of receptacle connectors, gaps are formed between the housing and the receptacle connectors when they are assembled. Thus, sounds generated by the audio equipment may leak from the gaps, resulting in sound defects. Sound defects render conventional multiple-in-one receptacle connectors unsuitable for high-quality audio applications, and reduce purchase intentions of consumers.

In addition, different types of receptacle connectors may be directly soldered on a circuit board in a parallel arrangement to form another type of multiple-in-one receptacle connector. Each receptacle connector includes terminals having soldering sections generally disposed at a back side and two sides of the receptacle connector itself. Because the position distribution of the soldering sections of the terminals of the receptacle connector is more uniform, the force applied to the receptacle connector soldered on the circuit board is more uniform when the corresponding plug connector is inserted into or withdrawn from the receptacle connector. However, more, receptacle connectors occupy more space on the circuit board, and need more procedures to solder onto the circuit board.

SUMMARY OF THE INVENTION

The present invention provides a multiple-in-one receptacle connector including a housing and receptacle connectors accommodated therein, capable of preventing sounds from leaking from gaps formed between the housing and the receptacle connectors when they are assembled.

According to an aspect of the present invention, there is provided a multiple-in-one receptacle connector including an insulating housing, receptacle connectors, and sealants. The insulating housing has a top surface and a bottom surface. The top surface has cavities disposed thereon. Each cavity has a bottom having through holes disposed thereon and penetrating through the bottom surface. Each receptacle connector includes terminals. Each terminal has a soldering section extending backward out of the corresponding receptacle connector. Each receptacle connector is accommodated in the corresponding cavity. The soldering sections of the terminals of each receptacle connector pass through the through holes disposed on the bottom of the corresponding cavity, respectively, to be out of the bottom surface. The sealants are disposed on the bottom surface. Each sealant seals gaps formed between the soldering sections of the terminals of each receptacle connector and the through holes disposed on the bottom of the corresponding cavity.

According to another aspect of the present invention, the bottom surface has troughs disposed thereon. The through holes disposed on the bottom of each cavity communicate with the corresponding trough. Each trough accommodates the corresponding sealant to seal the gaps formed between the soldering sections of the terminals of the corresponding receptacle connector and the through holes disposed on the bottom of the corresponding cavity.

According to another aspect of the present invention, the insulating housing has positioning posts disposed on edges of the bottom surface. The positioning posts are configured for inserting into a circuit board.

According to another aspect of the present invention, the positioning posts have lengths greater than those of the soldering sections of the terminals out of the bottom surface.

According to another aspect of the present invention, the insulating housing has positioning holes disposed on the bottom surface. The positioning holes are configured for providing an optical positioning for the multiple-in-one receptacle connector.

According to another aspect of the present invention, the receptacle connectors include an audio receptacle connector, a power receptacle connector, or a USB receptacle connector.

According to another aspect of the present invention, the audio receptacle connector further includes an insulating body having a coupling space. The terminals include signal terminals. Each signal terminal further has a fixing section and a contact section. The fixing section is fixed in the insulating body. The contact section extends forward from the fixing section into the coupling space. The soldering section extends backward from the fixing section out of the insulating body.

According to another aspect of the present invention, the USB receptacle connector further includes an insulating body and a shield shell. The insulating body has a body portion and a tongue portion extending forward from the body portion. The shield shell surrounds the insulating body and cooperates with the tongue portion to form a coupling space with the tongue portion. The terminals include signal terminals and shield ground terminals. Each signal terminal further has a fixing section and a contact section. The fixing section is fixed in the body portion. The contact section extends forward from the fixing section and is disposed on the tongue portion. The soldering section extends backward from the fixing section out of the body portion. The soldering section of each shield ground terminal extends backward from a back edge of the shield shell.

According to another aspect of the present invention, some soldering sections of the signal terminals are symmetrically bent sideward from the fixing sections and then extend backward.

According to another aspect of the present invention, the sealant is made of a thermoplastic film or an epoxy resin.

The aforementioned aspects or features can also be combined with each other and are in the scope of the present invention as well.

By disposing the sealants to seal the gaps formed between the soldering sections and the corresponding through holes, the multiple-in-one receptacle connector may prevent sounds from leaking from the gaps. Furthermore, by arranging the soldering sections of each receptacle connector disposed at a back side thereof and then integrating the receptacle connectors into the insulating housing, the multiple-in-one receptacle connector may occupy less space on the circuit board and need only one procedure to solder onto the circuit board. Moreover, by appropriately arranging the receptacle connectors and the soldering sections thereof, the force applied to the multiple-in-one receptacle connector may be more uniform when one plug connector is inserted into or withdrawn from one corresponding receptacle connector.

The foregoing, as well as additional objects, features and advantages of the present invention, will be more readily apparent from the following embodiments and detailed description, which proceed with reference to the accompanying drawings.

DESCRIPTION OF THE PREFERRED EMBODIMENTS

Figure 1:
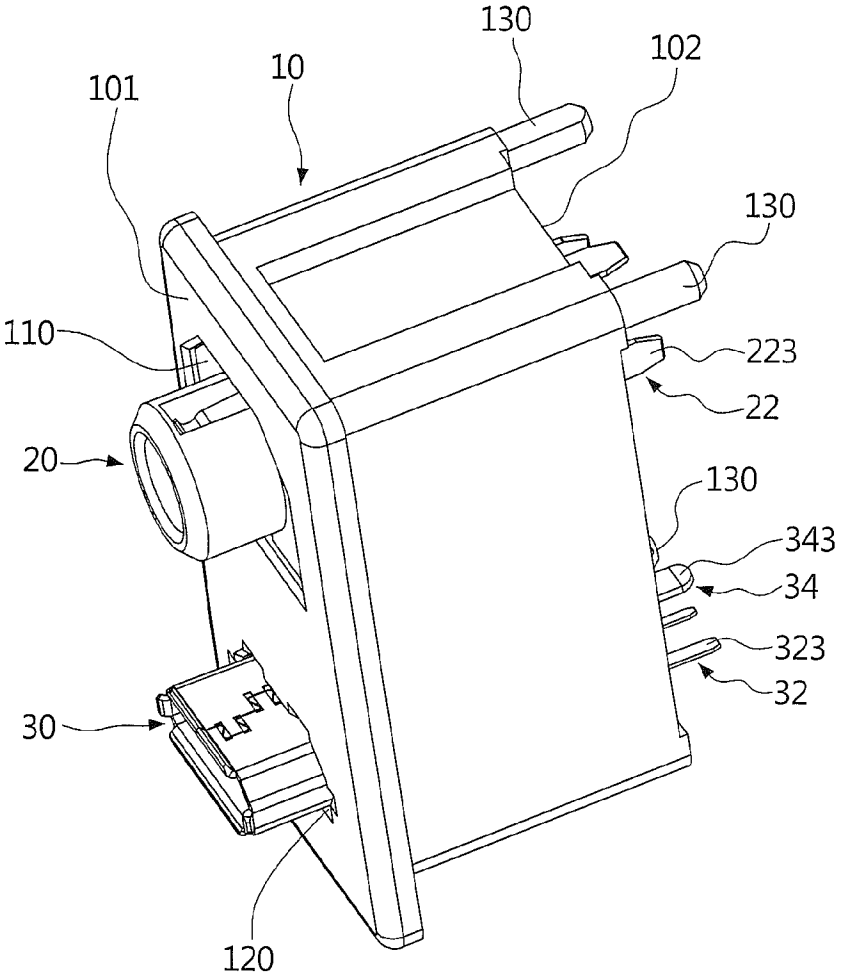
FIG. 1 is an assembled diagram of a multiple-in-one receptacle connector in a first view according to a preferred embodiment of the present invention.

Reference will now be made in detail to several embodiments of the present invention that are illustrated in the accompanying drawings. Wherever possible, the same or similar reference numerals are used in the drawings and the description to refer to the same or like parts. For purposes of convenience and clarity only, directional terms, such as top, bottom, forward, backward, sideward, front and back, may be used with respect to the drawings. These and similar directional terms should not be construed to limit the scope of the present invention in any manner.

Referring to FIG. 1 through FIG. 5, there are illustrated assembled and exploded diagrams of a multiple-in-one receptacle connector in different views according to a preferred embodiment of the present invention. In the embodiment, the multiple-in-one receptacle connector includes an insulating housing 10, receptacle connectors, and sealants 41 and 42. The receptacle connectors are an audio receptacle connector 20 and a USB receptacle connector 30 respectively. However, the embodiment is not limited to the present invention. For example, the multiple-in-one receptacle connector may include three or more receptacle connectors, and these receptacle connectors may be all the same, all different, or some the same and some different. In addition, these receptacle connectors may include an audio receptacle connector, a power receptacle connector, a Standard/Mini/Micro USB receptacle connector, a USB 2.0/3.0 receptacle connector, or any other type of receptacle connector.

The insulating housing 10 has a top surface 101 and a bottom surface 102. The top surface 101 has cavities 110 and 120 disposed thereon. The cavities 110 and 120 are configured for accommodating the audio receptacle connector 20 and the USB receptacle connector 30 respectively. The cavity 110 has a bottom (not shown) having through holes 111 disposed thereon, and the through holes 111 penetrate through the bottom surface 102 of the insulating housing 10. The cavity 120 has a bottom (not shown) having through holes 121 disposed thereon, and the through holes 121 penetrate through the bottom surface 102 of the insulating housing 10.

The audio receptacle connector 20 includes terminals 22. Each terminal 22 has a soldering section 223 extending backward out of the audio receptacle connector 20. When the audio receptacle connector 20 is accommodated in the cavity 110 of the insulating housing 10, the soldering sections 223 of the terminals 22 of the audio receptacle connector 20 pass through the through holes 111 disposed on the bottom of the cavity 110, respectively, to be out of the bottom surface 102 of the insulating housing 10.

The USB receptacle connector 30 includes terminals 32 and 34. Each terminal 32 (or 34) has a soldering section 323 (or 343) extending backward out of the USB receptacle connector 30. When the USB receptacle connector 30 is accommodated in the cavity 120 of the insulating housing 10, the soldering sections 323 and 343 of the terminals 32 and 34 of the USB receptacle connector 30 pass through the through holes 121 disposed on the bottom of the cavity 120, respectively, to be out of the bottom surface 102 of the insulating housing 10.

In addition, the bottom surface 102 of the insulating housing 10 has troughs 112 and 122 disposed thereon. The through holes 111 disposed on the bottom of the cavity 110 communicate with the trough 112, so that the through holes 111 penetrate through the bottom surface 102 of the insulating housing 10. The trough 112 is configured for accommodating the sealant 41 to seal gaps (not shown) formed between the soldering sections 223 of the terminals 22 of the audio receptacle connector 20 and the through holes 111 disposed on the bottom of the cavity 110. The through holes 121 disposed on the bottom of the cavity 120 communicate with the trough 122, so that the through holes 121 penetrate through the bottom surface 102 of the insulating housing 10. The trough 122 is configured for accommodating the sealant 42 to seal gaps (not shown) formed between the soldering sections 323 and 343 of the terminals 32 and 34 of the USB receptacle connector 30 and the through holes 121 disposed on the bottom of the cavity 120. The aforementioned sealant 41 or 42 may be made of a thermoplastic film or an epoxy resin.

The insulating housing 10 has positioning posts 130 disposed on edges of the bottom surface 102. The positioning posts 130 are configured for inserting into a circuit board (not shown). The positioning posts 130 have lengths greater than those of the soldering sections 223, 323, and 343 out of the bottom surface 102 of the insulating housing 10, so that the multiple-in-one receptacle connector may be easily inserted into the circuit board through a positioning provided by the positioning posts 130. The insulating housing 10 has positioning holes 140 disposed on the bottom surface 102. The positioning holes 140 are configured for providing an optical positioning for the multiple-in-one receptacle connector.

Therefore, by disposing or dispensing the sealants 41 and 42 into the troughs 112 and 122 to seal the gaps formed between the soldering sections 223, 323, and 343 and the corresponding through holes 111 and 121, the multiple-in-one receptacle connector may prevent sounds from leaking from the gaps. Furthermore, by arranging the soldering sections 223, 323, and 343 of the receptacle connectors 20 and 30 disposed at back sides thereof and then integrating the receptacle connectors 20 and 30 into the insulating housing 10, the multiple-in-one receptacle connector may occupy less space on the circuit board and need only one procedure to solder onto the circuit board. Moreover, by appropriately arranging the receptacle connectors 20 and 30 and the soldering sections 223, 323, and 343 thereof, the force applied to the multiple-in-one receptacle connector may be more uniform when one plug connector is inserted into or withdrawn from one corresponding receptacle connector.

Figure 6:
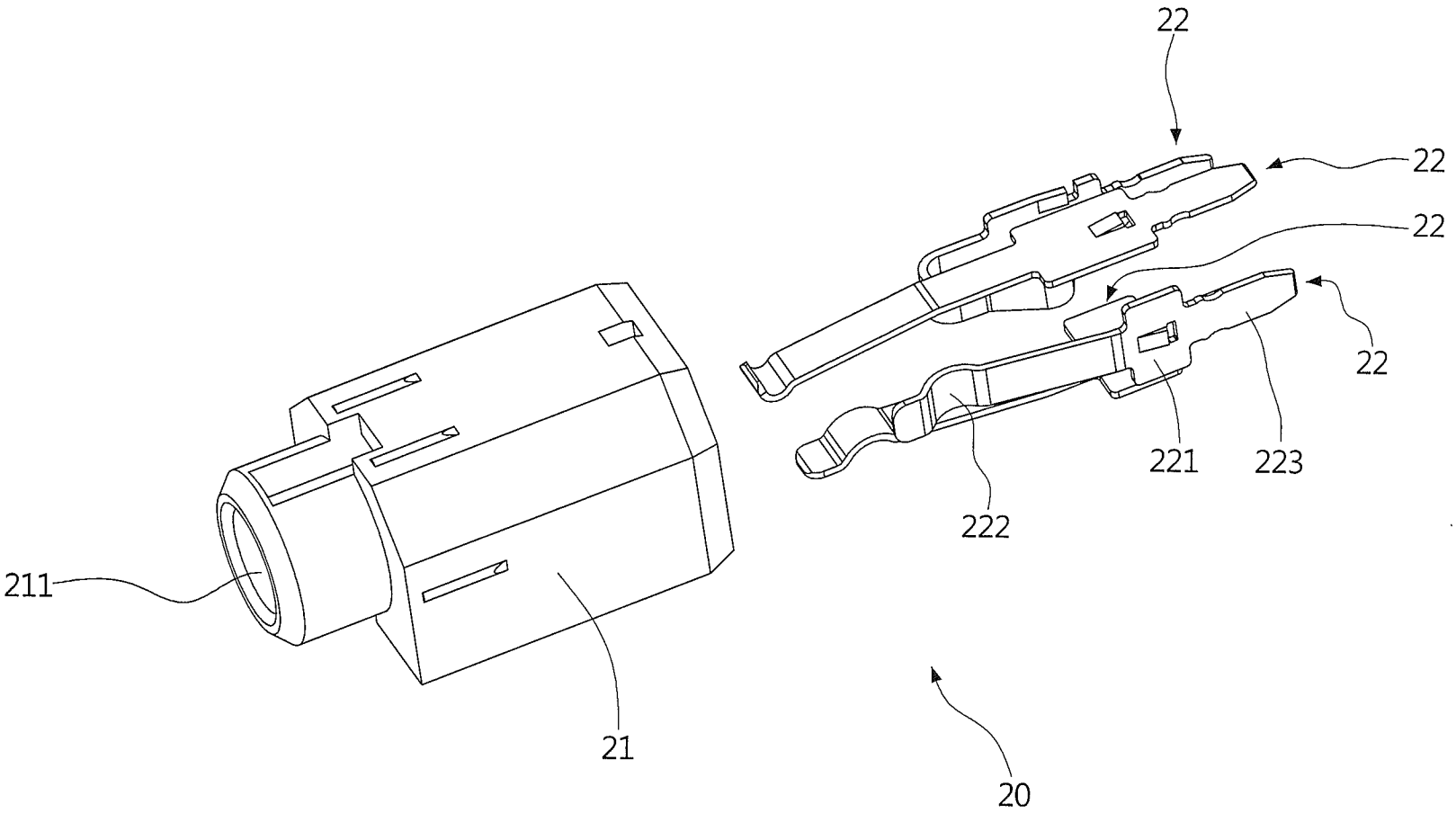
FIG. 6 is an exploded diagram of an audio receptacle connector according to a preferred embodiment of the present invention.

Referring to FIG. 6, there is illustrated an exploded diagram of an audio receptacle connector according to a preferred embodiment of the present invention. In the embodiment, the audio receptacle connector 20 includes an insulating body 21 and the aforementioned terminals 22. The terminals 22 are signal terminals. The insulating body 21 has a coupling space 211 configured for receiving an audio plug connector (not shown). Each signal terminal 22 has a fixing section 221, a contact section 222, and the aforementioned soldering section 223. The fixing section 221 is fixed in the insulating body 21. The contact section 222 extends forward from the fixing section 221 into the coupling space 211. The soldering section 223 extends backward from the fixing section 221 out of the insulating body 21.

However, the embodiment is not limited to the present invention. For example, the audio receptacle connector may further include a shield shell configured for suppressing crosstalk and noise. The shield shell has a shield ground terminal extending backward from a back edge thereof. Correspondingly, the bottom of the corresponding cavity further has an additional through hole disposed thereon and penetrating through the bottom surface of the insulating housing, so that the shield ground terminal passes through the additional through hole to be out of the bottom surface of the insulating housing. In addition, the audio receptacle connector may further include a detection terminal configured for detecting whether an audio plug connector is inserted into the coupling space to provide further functions.

Figure 2:
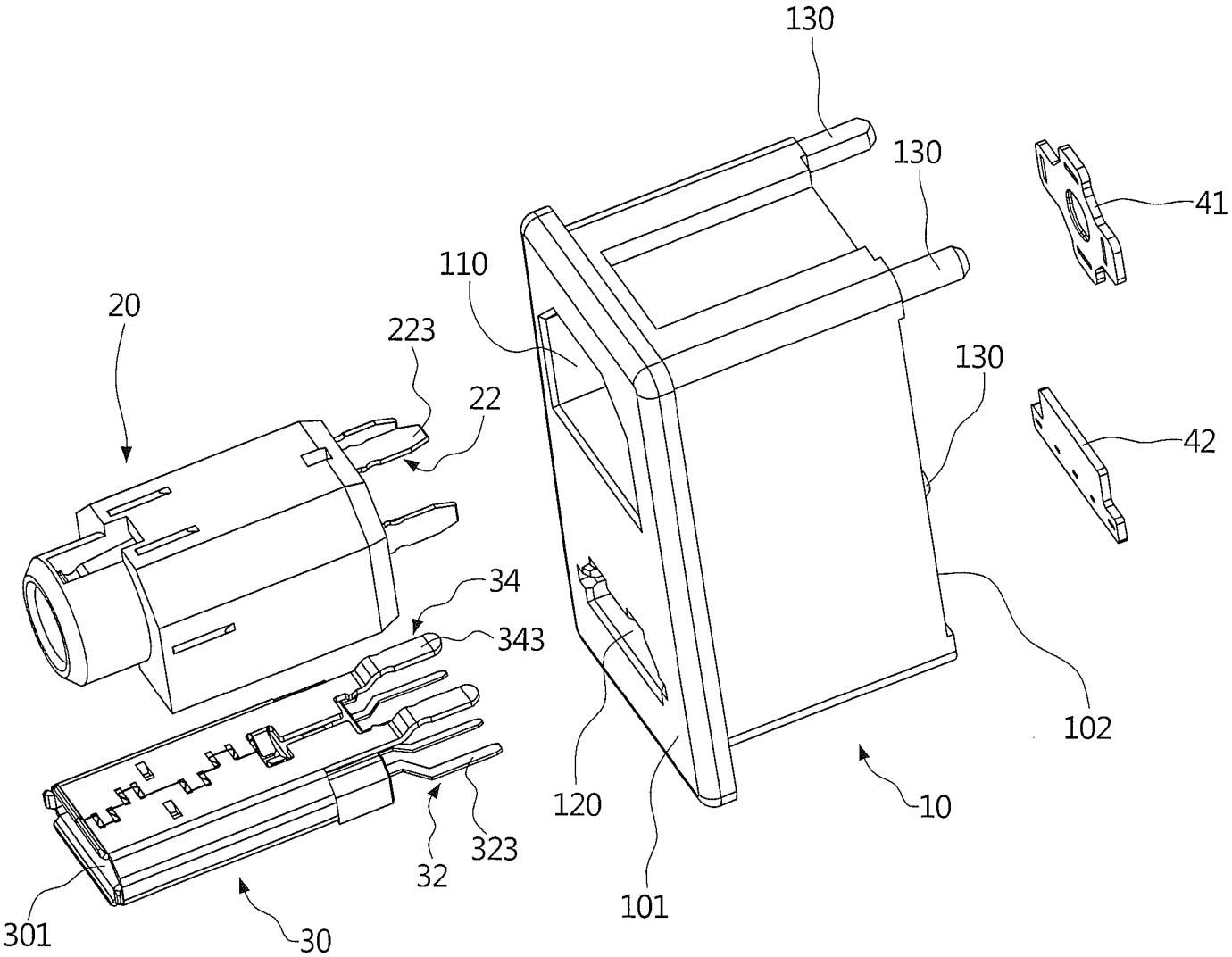
FIG. 2 is an exploded diagram of the multiple-in-one receptacle connector in the first view according to the preferred embodiment of the present invention.
Figure 7:
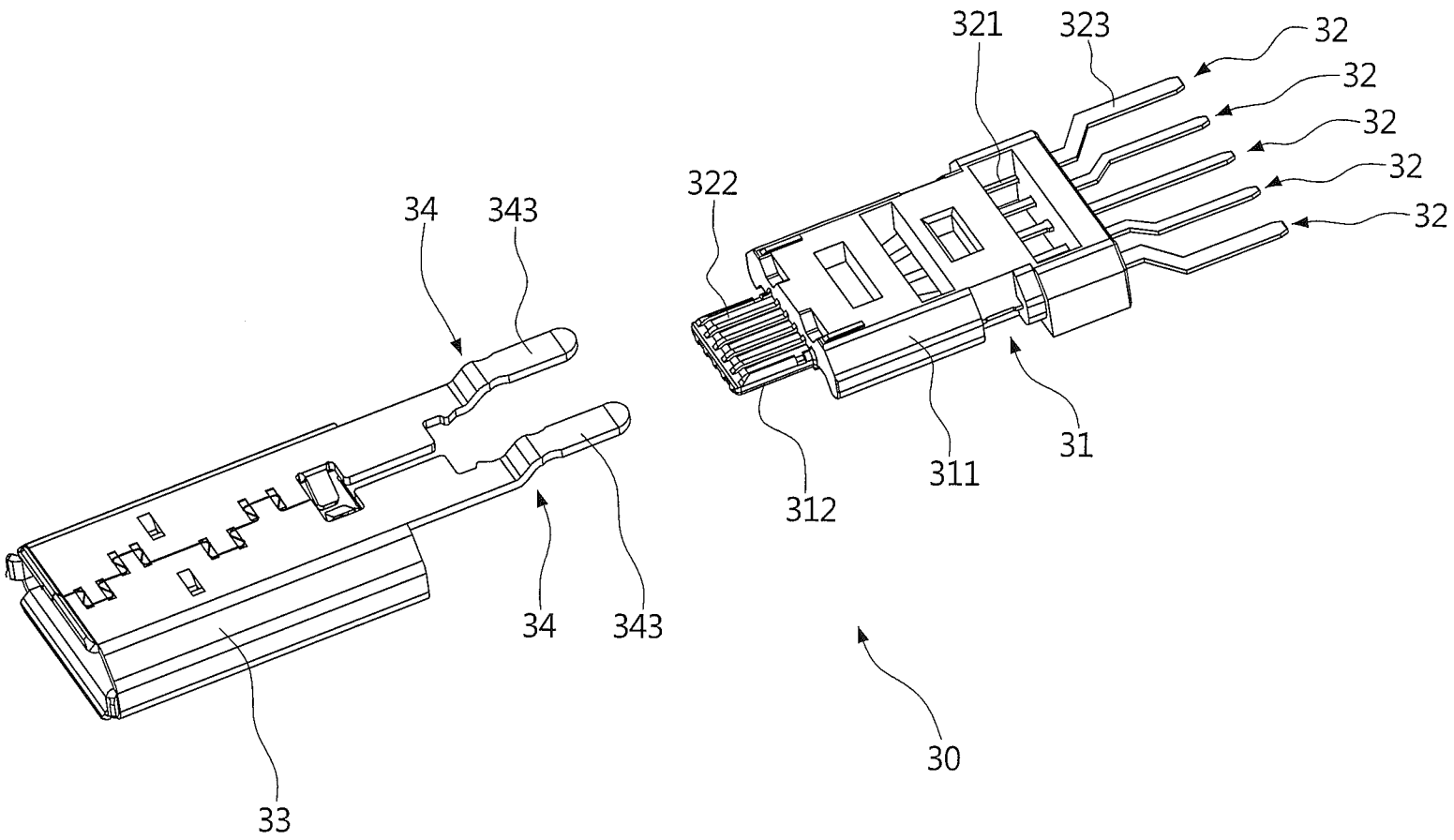
FIG. 7 is an exploded diagram of a USB receptacle connector according to a preferred embodiment of the present invention.

Referring to FIG. 7, there is illustrated an exploded diagram of a USB receptacle connector according to a preferred embodiment of the present invention. In the embodiment, the USB receptacle connector 30 includes an insulating body 31, the aforementioned terminals 32 and 34, and a shield shell 33. The terminals 32 are signal terminals, and the terminals 34 are shield ground terminals extending backward from a back edge of the shield shell 33. The insulating body 31 has a body portion 311 and a tongue portion 312 extending forward from the body portion 311. Each signal terminal 32 has a fixing section 321, a contact section 322, and the aforementioned soldering section 323. The fixing section 321 is fixed in the body portion 311. The contact section 322 extends forward from the fixing section 321 and is disposed on the tongue portion 312. The soldering section 323 extends backward from the fixing section 321 out of the body portion 311. The shield shell 33 surrounds the insulating body 31 and cooperates with the tongue portion 312 to form a coupling space 301 as shown in FIG. 2. The coupling space 301 is configured for receiving a USB plug connector (not shown). The shield shell 33 has shield ground terminals 34 extending backward from a back edge thereof. Each shield ground terminal 34 has the aforementioned soldering section 343.

Figure 3:
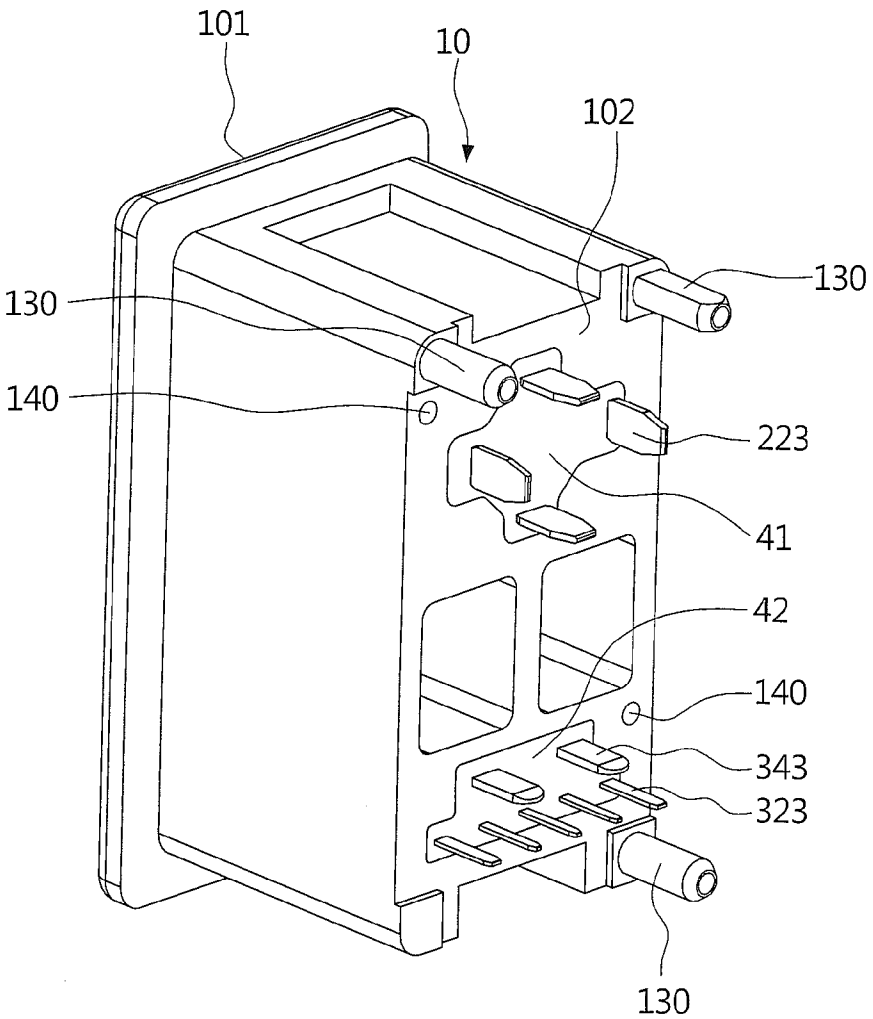
FIG. 3 is an assembled diagram of the multiple-in-one receptacle connector in a second view according to the preferred embodiment of the present invention.
Figure 4:
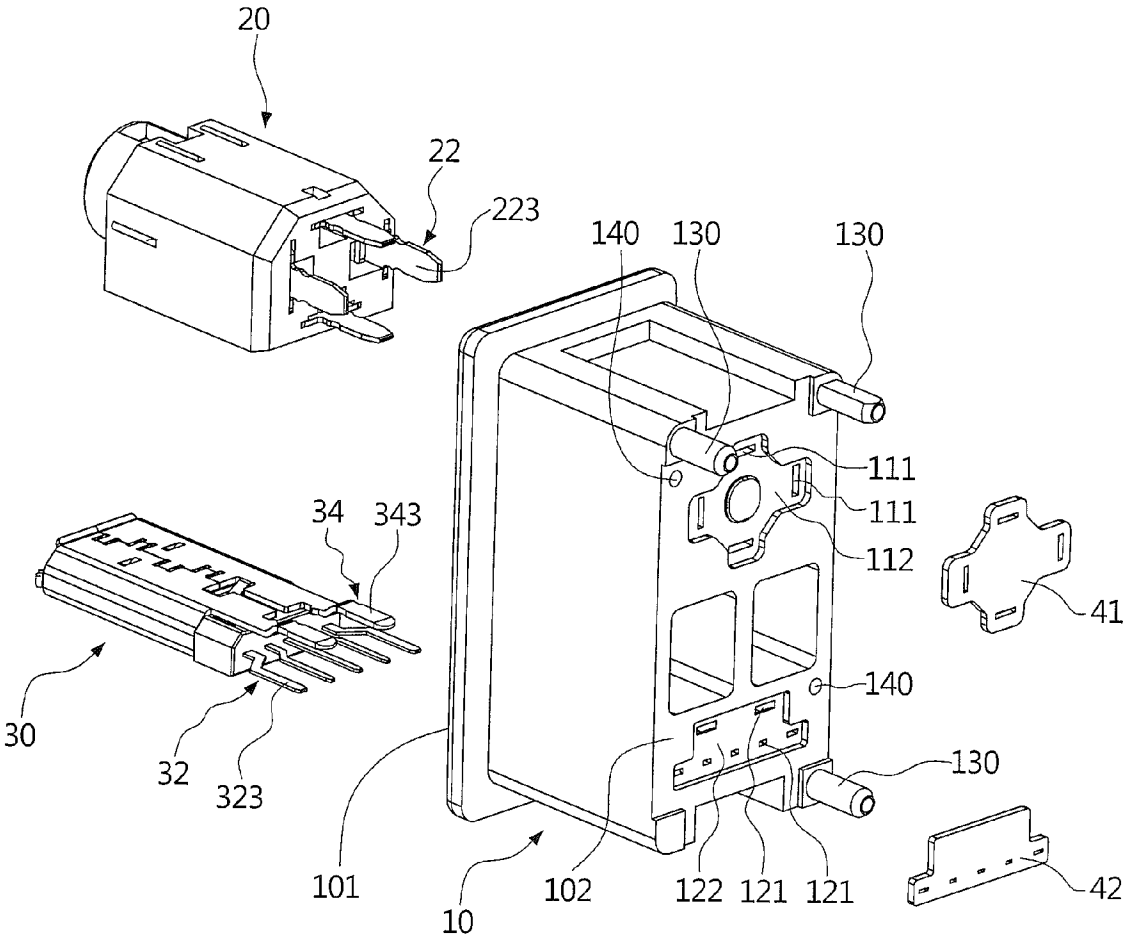
FIG. 4 is an exploded diagram of the multiple-in-one receptacle connector in the second view according to the preferred embodiment of the present invention.
Figure 5:
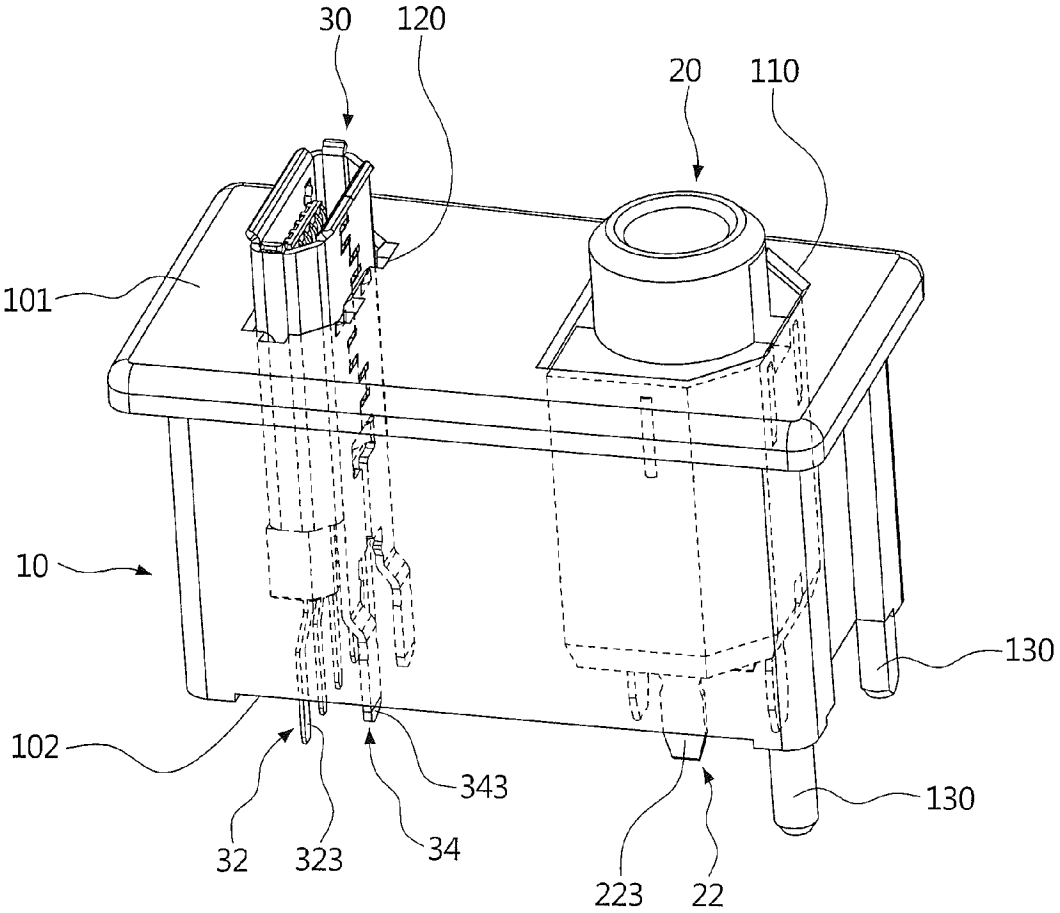
FIG. 5 is a perspective assembled diagram of the multiple-in-one receptacle connector in a third view according to the preferred embodiment of the present invention.

In addition, some soldering sections 323 of the signal terminals 32 are symmetrically bent sideward from the fixing sections 321 and then extend backward. Thus, the pitch of adjacent soldering sections 323 is increased, and the width of the distribution of the soldering sections 323 of the USB receptacle connector 30 is approximately equal to that of the soldering sections 223 of the audio receptacle connector 20 as shown in FIG. 3. Therefore, the soldering sections 223, 323, and 343 of the terminals 22, 32, and 34 of the receptacle connectors 20 and 30 have a uniform position distribution.

It will be apparent to those skilled in the art that various modifications and variations can be made to the structure of the present invention without departing from the scope or spirit of the present invention. In view of the foregoing, it is intended that the present invention cover modifications and variations of this invention provided they fall within the scope of the following claims and their equivalents.

What is claimed is:

1. A multiple-in-one receptacle connector comprising:

an insulating housing having a top surface and a bottom surface, wherein the top surface has a plurality of cavities extending therefrom towards but spaced from the bottom surface, wherein the plurality of cavities is spaced from each other, with each cavity having a bottom having a plurality of through holes extending therefrom and penetrating through the bottom surface;

a plurality of receptacle connectors, wherein each receptacle connector comprises a plurality of terminals, wherein each terminal has a soldering section extending backward out of the corresponding receptacle connector, wherein each receptacle connector is insertable accommodated in the corresponding cavity, wherein the soldering sections of the plurality of terminals of each receptacle connector pass through the through holes extending from the bottom of the corresponding cavity, respectively, to be out of the bottom surface; and a plurality of sealants disposed on the bottom surface, wherein each sealant seals gaps formed between the soldering sections of the plurality of terminals of each receptacle connector and the through holes extending from the bottom of the corresponding cavity.

2. The multiple-in-one receptacle connector of claim 1, wherein the bottom surface has a plurality of troughs disposed thereon, wherein the plurality of through holes extending from the bottom of each cavity communicates with the corresponding trough, wherein each trough accommodates the corresponding sealant to seal the gaps formed between the soldering sections of the plurality of terminals of the corresponding receptacle connector and the through holes extending from the bottom of the corresponding cavity.

3. The multiple-in-one receptacle connector of claim 2, wherein the plurality of troughs is spaced from each other.

4. The multiple-in-one receptacle connector of claim 1, wherein the insulating housing has a plurality of positioning posts disposed on edges of the bottom surface, wherein the positioning posts are configured for inserting into a circuit board.

5. The multiple-in-one receptacle connector of claim 4, wherein the plurality of positioning posts has a length greater than those of the soldering sections of the plurality of terminals out of the bottom surface.

6. The multiple-in-one receptacle connector of claim 1, wherein the insulating housing has a plurality of positioning holes disposed on the bottom surface, wherein the positioning holes are configured for providing an optical positioning for the multiple-in-one receptacle connector.

7. The multiple-in-one receptacle connector of claim 1, wherein the plurality of receptacle connectors comprises an audio receptacle connector, a power receptacle connector, or a Universal Serial Bus (USB) receptacle connector.

8. The multiple-in-one receptacle connector of claim 7, wherein the audio receptacle connector comprises an insulating body having a coupling space, wherein the plurality of terminals comprises a plurality of signal terminals, wherein each signal terminal further has a fixing section and a contact section, wherein the fixing section is fixed in the insulating body, wherein the contact section extends forward from the fixing section into the coupling space, and wherein the soldering section extends backward from the fixing section out of the insulating body.

9. The multiple-in-one receptacle connector of claim 7, wherein the USB receptacle connector comprises:

an insulating body having a body portion and a tongue portion extending forward from the body portion; and a shield shell surrounding the insulating body and cooperating with the tongue portion to form a coupling space, wherein the shield shell comprises a plurality of shield ground terminals, wherein a soldering section of each shield ground terminal extends backward from a back edge of the shield shell, wherein the soldering sections of the plurality of shield ground terminals pass through the plurality of through holes extending from the bottom of the corresponding cavity, respectively, to be out of the bottom surface, wherein the plurality of sealants seals gaps formed between the soldering sections of the plurality of shield ground terminals and the plurality of through holes, wherein the plurality of terminals comprises a plurality of signal terminals, wherein each signal terminal comprises a fixing section, the soldering section and a contact section, wherein the fixing section is fixed in the body portion, wherein the contact section extends forward from the fixing section and disposed on the tongue portion, wherein the soldering section extends backward from the fixing section out of the body portion.

10. The multiple-in-one receptacle connector of claim 9, wherein some soldering sections of the plurality of signal terminals are symmetrically bent sideward from the fixing sections and then extend backward.

11. The multiple-in-one receptacle connector of claim 1, wherein the sealant is made of a thermoplastic film or an epoxy resin.

* * * * *